US006641508B1

(12) United States Patent
Ignatovich

(10) Patent No.: US 6,641,508 B1
(45) Date of Patent: Nov. 4, 2003

(54) JUMP ROPE

(76) Inventor: Alex Ignatovich, 252 Sherman Ave., New York, NY (US) 10034

( * ) Notice: Subject to any disclaimer, the term of this patent is extended or adjusted under 35 U.S.C. 154(b) by 0 days.

(21) Appl. No.: 10/093,133

(22) Filed: Mar. 5, 2002

Related U.S. Application Data

(60) Provisional application No. 60/273,255, filed on Mar. 5, 2001.

(51) Int. Cl.[7] ..... A63B 5/20
(52) U.S. Cl. ..... 482/82
(58) Field of Search ..... 482/82, 81, 3, 482/7; 446/213, 242

(56) References Cited

U.S. PATENT DOCUMENTS 4,006,556 A * 2/1977 Williams ..... 446/242
4,139,966 A 2/1979 Connell
4,776,585 A * 10/1988 Maleyko et al. ..... 482/82
5,087,034 A * 2/1992 Solis ..... 482/82
5,108,340 A * 4/1992 Farrow ..... 446/242
5,389,056 A * 2/1995 Ricker ..... 482/82
5,842,766 A * 12/1998 Scharf, III ..... 482/82
6,001,048 A 12/1999 Taylor
6,409,636 B1 * 6/2002 Risso et al. ..... 482/82

FOREIGN PATENT DOCUMENTS

FR 2276069 * 1/1976 ..... 482/82

* cited by examiner

*Primary Examiner*—Jerome W. Donnelly
(74) *Attorney, Agent, or Firm*—Matthew J. Peirce

(57) ABSTRACT

A jump rope is disclosed with the jump rope comprising a plurality of lights that would be attached to the rope. The lights would electronically hooked up to one another. The handles of the jump rope would be hollow and would each have an internal battery compartment, with each battery compartment having at least one battery. The plurality of lights would be electronically hooked up to the batteries. The jump rope would have an on/off switch located on one of the two handles which a user would use to turn power to the plurality of lights and would also have an option switch that would also be located on one of the two handles which would allow a user to set the plurality of lights to different modes, such as constant, blinking, cascading, flashing, twinkling, or other possible options.

6 Claims, 2 Drawing Sheets

JUMP ROPE

This application claims the benefit of provisional Application No. 60/273,255, filed Mar. 5, 2001.

I. BACKGROUND OF THE INVENTION

The present invention concerns that of a new and improved apparatus for use when playing jump rope.

II. DESCRIPTION OF THE PRIOR ART

U.S. Pat. No. 6,001,048, issued to Taylor, discloses a musical jump rope which continuously plays a number of pre-programmed songs, and at the same time, provides a display with multiple colored or white incandescent lights.

U.S. Pat. No. 4,139,966, issued to Connell, discloses a trick rope device for forming a noose in a horizontal plane including a rope member having one end formed into a noose.

III. SUMMARY OF THE INVENTION

The present invention would be a new and improved jump rope, with the jump rope comprising a plurality of lights that would be attached to the rope. The lights would electronically hooked up to one another. The handles of the jump rope would be hollow and would each have an internal battery compartment, with each battery compartment having at least one battery. The plurality of lights would be electronically hooked up to the batteries. Each battery compartment would have a hatch which would allow a user to place batteries within each battery compartment. Each hatch would be located on the end of either handle or handle.

The jump rope would also have an on/off switch located on one of the two handles which a user would use to turn power to the plurality of lights. In addition, the jump rope would also have an option switch that would also be located on one of the two handles which would allow a user to set the plurality of lights to different modes, such as constant, blinking, cascading, flashing, twinkling, or other possible options.

There has thus been outlined, rather broadly, the more important features of a jump rope that the detailed description thereof that follows may be better understood and in order that the present contribution to the art may be better appreciated. There are, of course, additional features of the jump rope that will be described hereinafter and which will form the subject matter of the claims appended hereto.

In this respect, before explaining at least one embodiment of the jump rope in detail, it is to be understood that the jump rope is not limited in its application to the details of construction and to the arrangements of the components set forth in the following description or illustrated in the drawings. The jump rope is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present jump rope. It is important, therefore, that the claims be regarded as including such equivalent constructions insofar as they do not depart from the spirit and scope of the present invention.

It is therefore an object of the present invention to provide a jump rope which has all of the advantages of the prior art and none of the disadvantages.

It is another object of the present invention to provide a jump rope which may be easily and efficiently manufactured and marketed.

It is another object of the present invention to provide a jump rope which is of durable and reliable construction.

It is yet another object of the present invention to provide a jump rope which is economically affordable and available for the consumer market.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
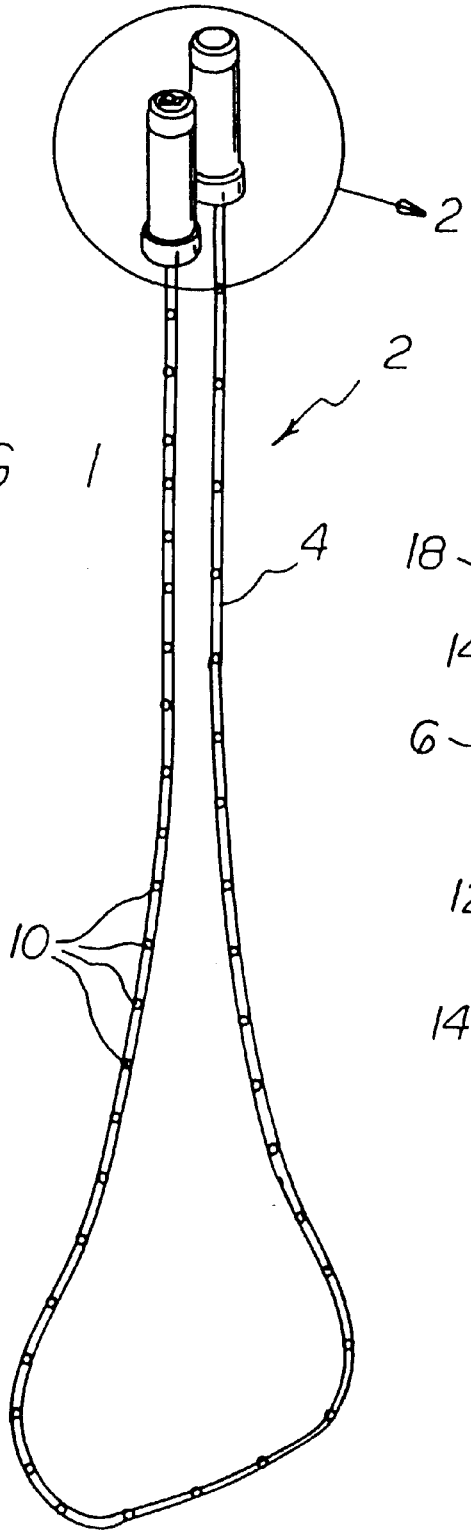
FIG. 1 shows a perspective view of the present invention.

FIG. 1 shows a perspective view of the present invention. The present invention would be a new and improved jump rope 2, with the jump rope 2 comprising a rope 4, handles 6 and 8, and a plurality of lights 10 that would be attached to the rope 4. The lights would electronically hooked up to one another.

Figure 2:
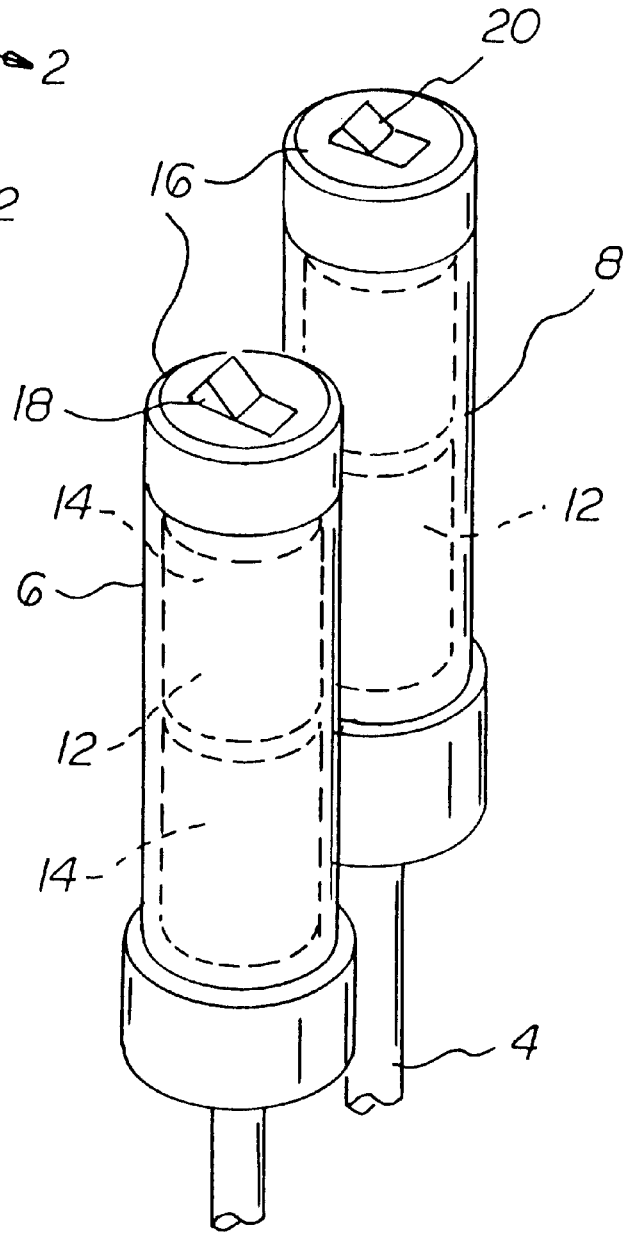
FIG. 2 shows a close-up perspective view of the handles of the jump rope of the present invention.

FIG. 2 shows a close-up perspective view of the handles 6 and 8 of the jump rope 2. Handles 6 and 8 would be hollow and would each have an internal battery compartment 12, with each battery compartment 12 having at least one battery 14. The plurality of lights 10 would be electronically hooked up to the batteries 14 that would be located in each battery compartment 12. Each battery compartment 12 would have a hatch 16 which would allow a user to place batteries 14 within each battery compartment 12. Each hatch 16 would be located on the end of either handle 6 or handle 8.

Jump rope 2 would also have an on/off switch 18 located on either handle 6 or handle 8. A user would use on/off switch 18 to turn power to the plurality of lights 10 on or off and would have two positions, an "on" position and an "off" position. In addition, jump rope 2 would also have an option switch 20 that would also be located on either handle 6 or handle 8. Option switch 20 would allow a user to set the plurality of lights 10 to different modes, such as constant, blinking, cascading, flashing, twinkling, or other possible options. The different modes listed herein for the plurality of lights 10 are not designed to be all in-inclusive or limiting, as other modes of lighting could be used with the plurality of lights 10.

Figure 3:
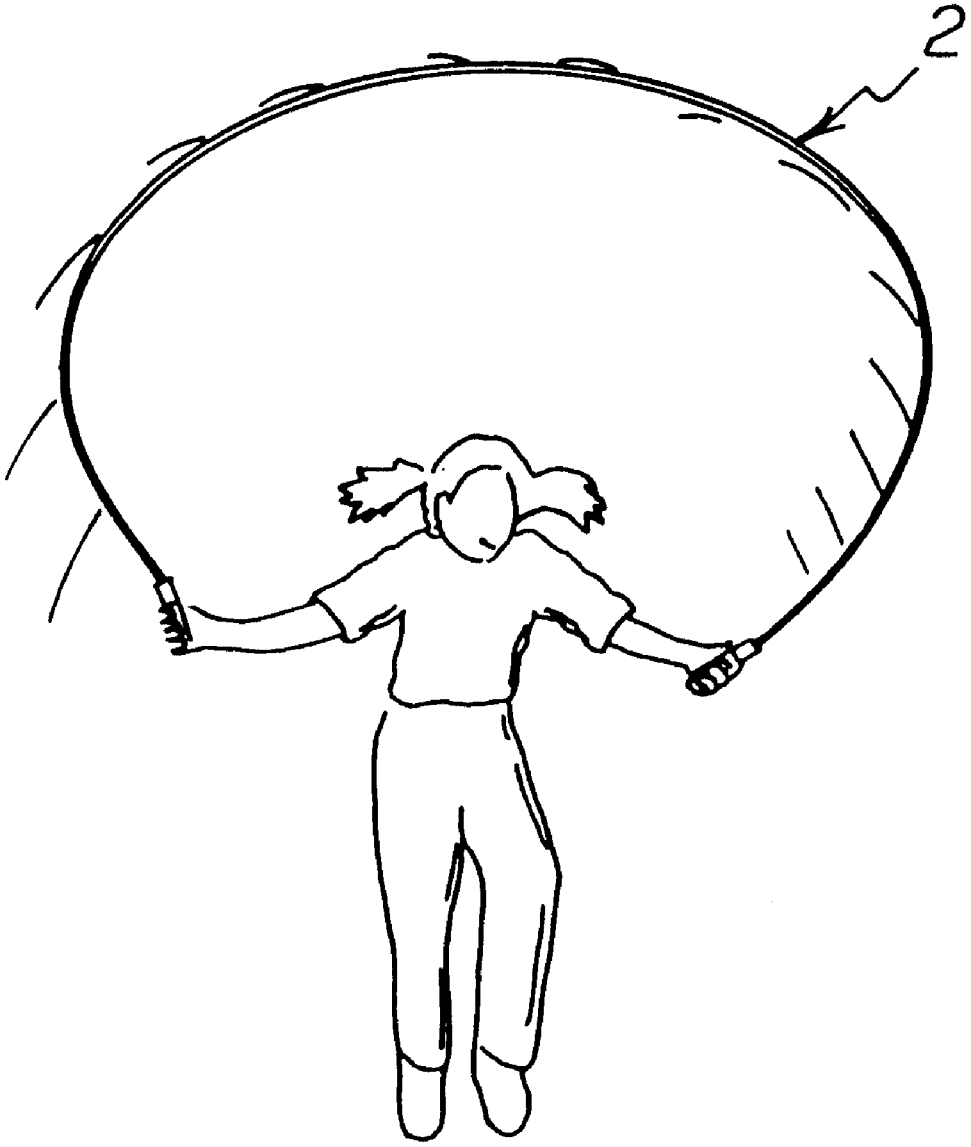
FIG. 3 shows the present invention as it would appear in use.

FIG. 3 shows the present invention as it would appear in use.

What is claimed is:

1. A jump rope comprising:

(a) a length of rope having two ends, a first end and a second end, (b) a pair of handles, a first handle and a second handle, each handle preferably having a cylindrical shape, each handle having two ends, a first end and a second end, the first end of the first handle being attached to the first end of the rope, the first end of the second handle being attached to the second end of the rope, each handle having an internal battery compartment, each handle further including a removable hatch on the second end of each handle to allow access to each internal battery compartment, (c) a plurality of lights attached to the length of rope, the lights being electronically connected to the internal battery compartments within the first handle and the second handle, (d) power means for providing power to the plurality of lights (e) at least one battery in the internal compartment within the first handle, (f) at least one battery in the internal battery compartment within the second handle, (g) an on/off switch attached to the first handle, the on/off switch having two positions, an "on" position and an "off" position, the on/off switch acting as a circuit between the batteries within the internal battery compartments and the plurality of lights, and (h) an option switch attached to the second handle, the option switch having plurality of settings, each of the settings designed to turn the plurality of lights on and off in varying patterns provided that the on/off switch woulf be set to the "on" positions.

2. A jump rope according to claim 1 wherein at least one of the settings on the option switch would cause the plurality of lights to emit a blinking pattern.

3. A jump rope according to claim 1 wherein at least one of the settings on the option switch would cause the plurality of lights to constantly remain lit.

4. A jump rope according to claim 1 wherein at least one of the settings on the option switch would cause the plurality of lights to emit a cascading pattern.

5. A jump rope according to claim 1 wherein at least one of the settings on the option switch would cause the plurality of lights to emit a flashing pattern.

6. A jump rope according to claim 1 wherein at least one of the settings on the option switch would cause the plurality of lights to emit a twinkling pattern.

* * * * *